US005868269A

United States Patent [19]

Juarez

[11] Patent Number: 5,868,269

[45] Date of Patent: Feb. 9, 1999

[54] PORTABLE ARTICLE CARRIER APPARATUS

[76] Inventor: Shirley M. Juarez, 155 Angleview Dr., Wendell, N.C. 27591

[21] Appl. No.: 724,327

[22] Filed: Oct. 1, 1996

[51] Int. Cl.[6] ..... B65D 25/04

[52] U.S. Cl. ..... 220/529; 220/554; 220/771

[58] Field of Search ..... 220/529, 554, 220/771, 505, 503, 500, 912

[56] References Cited

U.S. PATENT DOCUMENTS

| | | | |
|---|---|---|---|
| 598,801 | 2/1898 | Minter | 220/529 |
| 855,963 | 6/1907 | Morrison | 220/529 |
| 2,244,950 | 6/1941 | Jones | 220/529 |
| 2,559,699 | 7/1951 | Bard et al. | 220/529 |
| 4,052,034 | 10/1977 | Marceno . | |
| 4,446,982 | 5/1984 | Corse . | |
| 4,583,955 | 4/1986 | Toloczko . | |
| 4,694,961 | 9/1987 | Menendez . | |
| 4,844,243 | 7/1989 | Stiles . | |
| 5,133,474 | 7/1992 | Smith et al. | 220/529 |
| 5,150,794 | 9/1992 | Rooks | 220/554 |
| 5,271,520 | 12/1993 | McAfee | 220/529 |

FOREIGN PATENT DOCUMENTS

| | | | |
|---|---|---|---|
| 17383 | 6/1913 | Denmark | 220/554 |
| 1487903 | 7/1967 | France | 220/529 |
| 510142 | 7/1939 | United Kingdom | 220/529 |

*Primary Examiner*—Stephen J. Castellano

[57] ABSTRACT

A portable article carrier apparatus includes a floor and a plurality of walls extending upward from the floor. The floor and the walls define an interior storage space, Each of the walls includes a bottom wall portion, a top wall portion, and an intermediate wall portion between the bottom wall portion and the top wall portion. Partition-support brackets are connected to intermediate wall portions of the walls and project into the interior storage space. A removable and replaceable partition is supported by the partition-support brackets. A lid is supported by the top wall portions of the walls. The walls are connected to the floor at an obtuse slant angle. The obtuse slant angle flares the walls outward, whereby the partition is permitted to be easily placed in and removed from the interior storage space. As a result of the outwardly flaring walls, the length and width of the floor are smaller than the corresponding dimensions of the partition; and the length and width of the partition are smaller than the corresponding dimensions of the lid. The lid includes a lid handle, and the partition includes a partition handle. The partition handle is comprised of a pair of grab apertures located in the partition.

1 Claim, 3 Drawing Sheets

PORTABLE ARTICLE CARRIER APPARATUS

BACKGROUND OF THE INVENTION

1. Field of the Invention

The present invention relates generally to article carriers and, more particularly, to article carriers that are portable and that have a removable lid.

2. Description of the Prior Art

When a person is to carry a plurality of small articles, the person often employs a portable article carrier. There are articles, however, which require special handling in order not to damage them when being carried in the portable article carrier. For example, cupcakes generally have two major portions, a bottom cake portion and a top icing portion. When a plurality of cupcakes are carried in a portable article carrier, care must be taken so that the relatively delicate icing portions of the cupcakes are not damaged during transport. In this regard, throughout the years, a number of innovations have been developed relating to carriers for cupcakes, and the following U.S. Pat. Nos. are representative of some of those innovations: 4,052,034, 4,446,982, 4,583,955, 4,694,961, and 4,844,243. All of the prior art cited above have a common feature. They disclose cupcake carriers that carry a plurality of cupcakes in a single layer.

When a large number of cupcakes are to be carried, if only a single layer of cupcakes are carried, the carrier may have to be quite large. To provide an efficient carrier, it would be desirable if a portable carrier for cupcakes could carry a plurality of cupcakes in a plurality of layers.

However, great care must be exercised in carrying cupcakes in plural layers because the delicate icing portions of cupcakes in a lower layer may be damaged by overlying bottom cake portions of cupcakes in an overlying layer of cupcakes. In this respect, it would be desirable if a portable carrier for cupcakes were provided which prevents the delicate icing portions of cupcakes in a lower layer from being damaged by overlying bottom cake portions of cupcakes in an overlying layer of cupcakes.

Still other features would be desirable in a portable article carrier that is especially useful for carrying food items such as cupcakes. For example, to keep out pests, it would be desirable if the portable article carrier could be fully enclosed when not being accessed. In this respect, it would be desirable if a portable article carrier had a lid which includes a handle which permits easy removal and replacement of the lid.

To protect a layer of underlying articles from being damaged by a overlying layer of articles, it would be desirable if a portable article carrier were provided which provides a protective cover for underlying articles. To provide a device which optimizes the functional utility of component parts, it would be desirable if a protective cover for a lower layer of articles could also serve as a carrying floor for an upper layer of articles. To facilitate removal of a combined cover/floor from an article carrier, it would be desirable if the cover/floor were provided with a handle which permits easy lifting and lowering of the combined cover/floor.

To provide a portable article carrier that is lightweight and easy to clean, it would be desirable if the portable article carrier were made from lightweight and washable plastic materials.

Thus, while the foregoing body of prior art indicates it to be well known to use portable article carriers, the prior art described above does not teach or suggest a portable article carrier apparatus which has the following combination of desirable features: (1) can carry a plurality of articles, such as cupcakes, in a plurality of layers; (2) prevents the delicate icing portions of cupcakes in a lower layer from being damaged by overlying bottom cake portions of cupcakes in an overlying layer of cupcakes; (3) can be fully enclosed when not being accessed; (4) has a lid which includes a handle which permits easy removal and replacement of the lid; (5) provides a protective cover for underlying articles; (6) provides a protective cover for a lower layer of articles which can also serve as a carrying floor for an upper layer of articles; (7) provides a cover/floor with a handle which permits easy lifting and lowering of the combined cover/floor; and (8) is made from lightweight and washable plastic materials. The foregoing desired characteristics are provided by the unique portable article carrier apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a portable article carrier apparatus which includes a floor and a plurality of walls extending upward from the floor. The floor and the walls define an interior storage space, Each of the walls includes a bottom wall portion, a top wall portion, and an intermediate wall portion between the bottom wall portion and the top wall portion. Partition-support brackets are connected to intermediate wall portions of the walls and project into the interior storage space. A removable and replaceable partition is supported by the partition-support brackets. A lid is supported by the top wall portions of the walls.

The walls are connected to the floor at an obtuse slant angle. The obtuse slant angle flares the walls outward, whereby the partition is permitted to be easily placed in and removed from the interior storage space. As a result of the outwardly flaring walls, the length and width of the floor are smaller than the corresponding dimensions of the partition; and the length and width of the partition are smaller than the corresponding dimensions of the lid. The lid includes a lid handle, and the partition includes a partition handle. The partition handle is comprised of a pair of grab apertures located in the partition.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable article carrier apparatus which has all of the advantages of the prior art and none of the disadvantages.

It is another object of the present invention to provide a new and improved portable article carrier apparatus which may be easily and efficiently manufactured and marketed.

It is a further object of the present invention to provide a new and improved portable article carrier apparatus which is of durable and reliable construction.

An even further object of the present invention is to provide a new and improved portable article carrier apparatus which is susceptible of a low cost of manufacture with regard to both materials and labor, and which accordingly is then susceptible of low prices of sale to the consuming public, thereby making such portable article carrier apparatus available to the buying public.

Still yet a further object of the present invention is to provide a new and improved portable article carrier apparatus which can carry a plurality of articles, such as cupcakes, in a plurality of layers.

Still another object of the present invention is to provide a new and improved portable article carrier apparatus that prevents the delicate icing portions of cupcakes in a lower layer from being damaged by overlying bottom cake portions of cupcakes in an overlying layer of cupcakes.

Yet another object of the present invention is to provide a new and improved portable article carrier apparatus which can be fully enclosed when not being accessed.

Even another object of the present invention is to provide a new and improved portable article carrier apparatus that has a lid which includes a handle which permits easy removal and replacement of the lid.

Still a further object of the present invention is to provide a new and improved portable article carrier apparatus which provides a protective cover for underlying articles.

Yet another object of the present invention is to provide a new and improved portable article carrier apparatus that provides a protective cover for a lower layer of articles which can also serve as a carrying floor for an upper layer of articles.

Still another object of the present invention is to provide a new and improved portable article carrier apparatus which provides a cover/floor with a handle which permits easy lifting and lowering of the combined cover/floor.

Yet another object of the present invention is to provide a new and improved portable article carrier apparatus that is made from lightweight and washable plastic materials.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
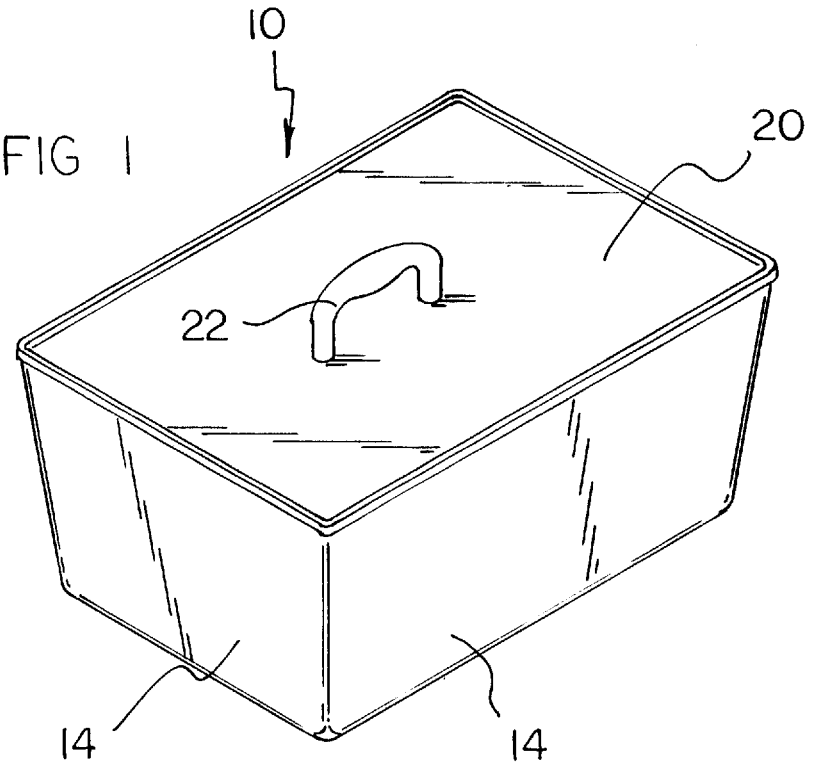
FIG. 1 is a perspective view showing a preferred embodiment of the portable article carrier apparatus of the invention with a lid in place.
Figure 2:
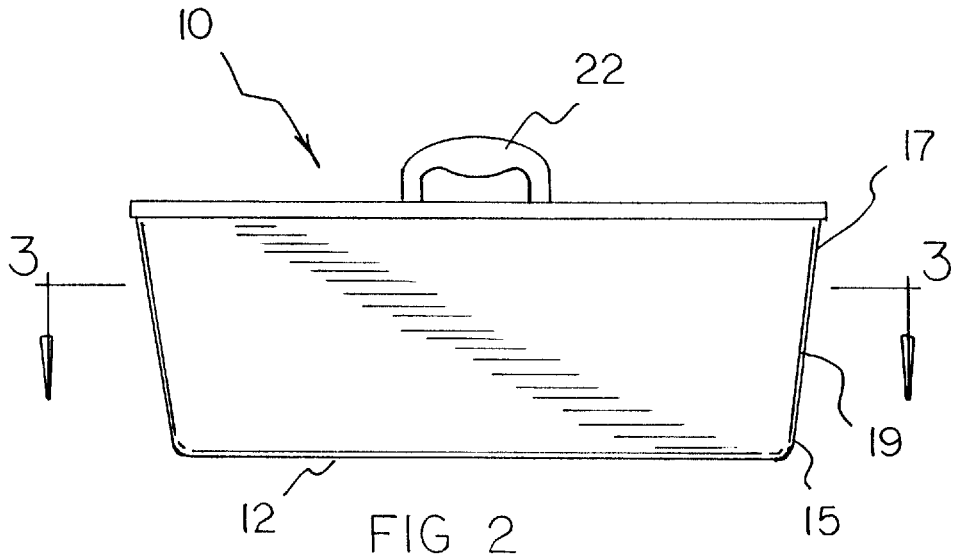
FIG. 2 is a side view of the embodiment of the invention shown in FIG. 1.
Figure 3:
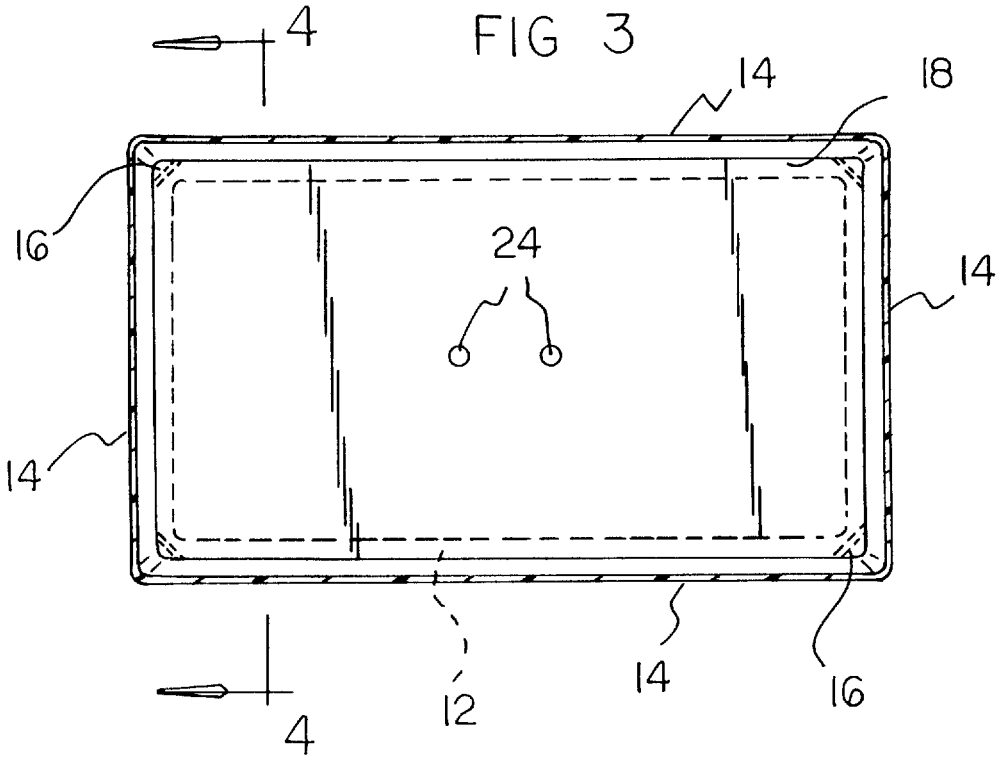
FIG. 3 is an enlarged cross-sectional view of the embodiment of the portable article carrier apparatus of FIG. 2 taken along line 3—3 thereof.

With reference to the drawings, a new and improved portable article carrier apparatus embodying the principles and concepts of the present invention will be described.

Turning to FIGS. 1–5, there is shown an exemplary embodiment of the portable article carrier apparatus of the invention generally designated by reference numeral 10. In its preferred form, portable article carrier apparatus 10 includes a floor 12 and a plurality of walls 14 extending upward from the floor 12. The floor 12 and the walls 14 define an interior storage space 13, Each of the walls 14 includes a bottom wall portion 15, a top wall portion 17, and an intermediate wall portion 19 between the bottom wall portion 15 and the top wall portion 17. Partition-support brackets 16 are connected to intermediate wall portions 19 of the walls 14 and project into the interior storage space 13. A removable and replaceable partition 18 is supported by the partition-support brackets 16. A lid 20 is supported by the top wall portions 17 of the walls 14. The walls 14 are connected to the floor 12 at an obtuse slant angle 21.

The partition 18 has a partition length 25; the lid 20 has a lid length 27; and the partition length 25 is less than the lid length 27. The partition 18 has a partition width 29; the lid 20 has a lid width 31; and the partition width 29 is less than the lid width 31. The lid 20 includes a lid handle 22, and the partition 18 includes a partition handle. The partition handle is comprised of a pair of grab apertures 24 located in the partition 18.

Figure 4:
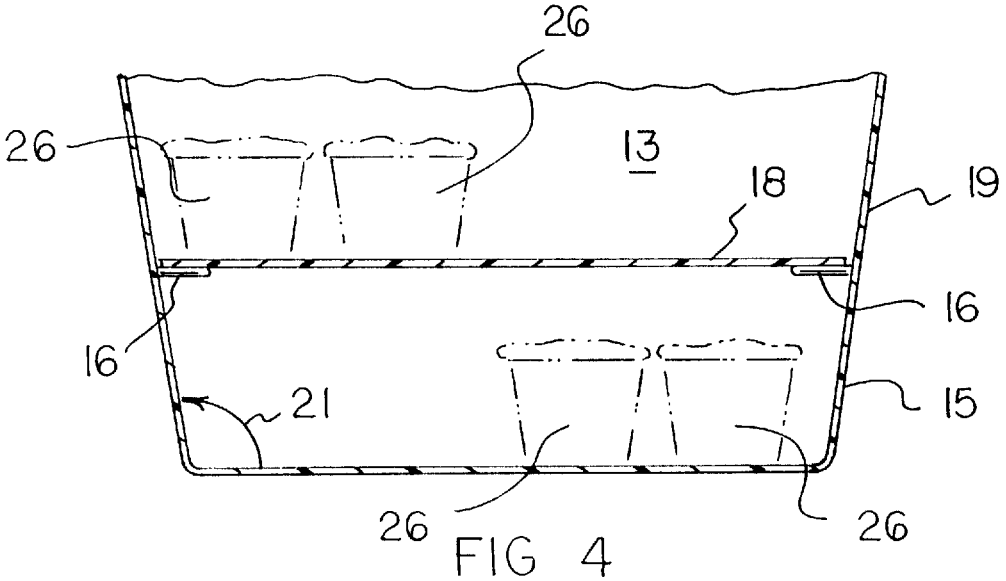
FIG. 4 is an enlarged cross-sectional view of a portion of the embodiment of the portable article carrier apparatus of FIG. 3 taken along line 3—3 thereof.
Figure 5:
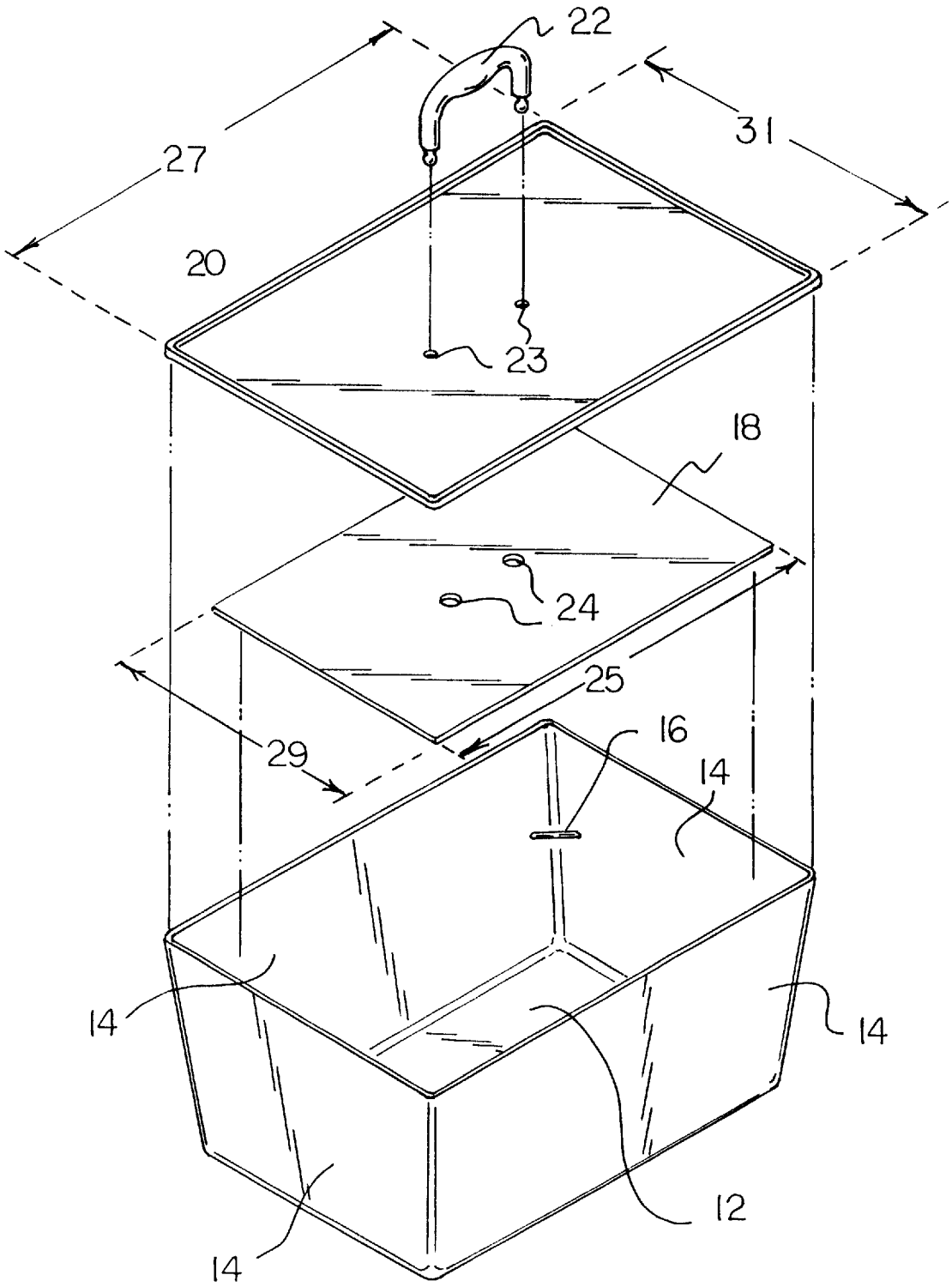
FIG. 5 is an exploded perspective view of the embodiment of the invention shown in FIGS. 1–4.

In using the portable article carrier apparatus 10 of the invention, the lid 20 is removed from the top wall portions 17, the partition 18 is lifted off of the partition-support brackets 16 and is removed from the interior storage space 13. As shown in FIG. 4, a plurality of articles, such as cupcakes 26, are placed in a layer on the floor 12. The tops of the cupcakes 26 are located below the level of the partition-support brackets 16. Then, the partition 18 is placed on the partition-support brackets 16, and the partition 18 is located above the cupcakes 26 on the floor 12. A person can use one's index finger and one's thumb to engage the grab apertures 24 to handle the partition 18. Additional cupcakes 26 are placed on the partition 18. Finally, the lid 20 is placed on the top wall portions 17, whereby the cupcakes 26 that are on the partition 18 are located below the lid 20. Clearly, the partition 18 serves as a cover for the cupcakes 26 located on the floor 12. In addition, it is clear that the partition 18 serves as a floor for the cupcakes 26 supported by the partition 18. The lid 20 serves to enclose all of the cupcakes 26 in the interior storage space 13 of the portable article carrier apparatus 10.

Clearly, when using the portable article carrier apparatus 10 for storing and carrying plural layers of cupcakes 26, the icing on the cupcakes 26 in any of the layers is not damaged by cupcakes 26 in an upper or lower layer during storing or transportation.

In manufacturing the portable article carrier apparatus 10 of the invention, the floor 12, the walls 14, and the partition-support brackets 16 can be made as a unified, integrated structure. The lid handle 22 can fit into handle reception apertures 23 in the lid 20. Ends of the lid handle 22 can be secured to the handle reception apertures 23 using a suitable adhesive composition.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved portable article carrier apparatus that is low in cost, relatively simple in design and operation, and which may advantageously be used to carry a plurality of articles, such as cupcakes, in a plurality of layers. With the invention, a portable article carrier apparatus is provided which prevents the delicate icing portions of cupcakes in a lower layer from being damaged by overlying bottom cake portions of cupcakes in an overlying layer of cupcakes. With the invention, a portable article carrier apparatus is provided which can be fully enclosed when not being accessed. With the invention, a portable article carrier apparatus is provided which has a lid which includes a handle which permits easy removal and replacement of the lid. With the invention, a portable article carrier apparatus provides a protective cover for underlying articles. With the invention, a portable article carrier apparatus provides a protective cover for a lower layer of articles which can also serve as a carrying floor for an upper layer of articles. With the invention, a portable article carrier apparatus provides a cover/floor with a handle which permits easy lifting and lowering of the combined cover/floor. With the invention, a portable article carrier apparatus is provided which is made from lightweight and washable plastic materials.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A portable article carrier apparatus comprising:

a floor;

a plurality of walls extending upward from said floor, wherein said floor and said walls define an interior storage space, and wherein each of said walls includes a bottom wall portion, a top wall portion, and an intermediate wall portion between said bottom wall portion and said top wall portion;

partition-support brackets connected to intermediate wall portions of said walls and projecting into said interior storage space;

a removable and replaceable partition supported by said partition-support brackets, said partition being substantially imperforate except for a pair of spaced grab apertures extending through said partition whereby objects placed on said partition are supported above the partition;

a lid supported by said top wall portions of said walls, said lid being freely separable from the walls and partition of the portable article carrier apparatus, said lid including a lid handle coupled only to said lid, said lid handle permitting free removal of said lid separately from the partition of the portable article carrier apparatus;

wherein said walls are connected to said floor at an obtuse slant angle;

wherein said partition has a partition length, said lid has a lid length, and said partition length is less than said lid length, and further wherein said partition has a partition width, said lid has a lid width, and said partition width is less than said lid width.

* * * * *